US008262514B2

(12) United States Patent
Spiegel et al.

(10) Patent No.: US 8,262,514 B2
(45) Date of Patent: Sep. 11, 2012

(54) FOOTBALL TEE WITH MULTIPLE BALL SUPPORTING MODES

(76) Inventors: H. Jay Spiegel, Mount Vernon, VA (US); Shaun Suisham, Greenville, OH (US)

( * ) Notice: Subject to any disclaimer, the term of this patent is extended or adjusted under 35 U.S.C. 154(b) by 0 days.

(21) Appl. No.: 12/923,105

(22) Filed: Sep. 2, 2010

(65) Prior Publication Data

US 2012/0058841 A1 Mar. 8, 2012

(51) Int. Cl.
*A63B 69/00* (2006.01)

(52) U.S. Cl. ..... 473/420; 473/419

(58) Field of Classification Search ..... 473/420, 473/419, 417, 438, 387, 396; D21/716, 717, D21/788, 793; 248/121, 156
See application file for complete search history.

(56) References Cited

U.S. PATENT DOCUMENTS

| | | | | | |
|---|---|---|---|---|---|
| 1,783,211 | A | * | 12/1930 | Baldwin | 473/257 |
| 2,659,604 | A | * | 11/1953 | McGowen | 473/420 |
| D176,029 | S | * | 11/1955 | Martin | D21/716 |
| D195,088 | S | | 4/1963 | Box | |
| D202,433 | S | | 9/1965 | Cullity | |
| 3,309,087 | A | * | 3/1967 | Cullity | 473/420 |
| 3,481,602 | A | * | 12/1969 | Tatter | 473/420 |
| 4,019,735 | A | * | 4/1977 | Thompson | 473/420 |
| 4,313,604 | A | * | 2/1982 | Baxter | 473/132 |
| D269,890 | S | | 7/1983 | Stenerud | |
| 4,418,910 | A | | 12/1983 | Stenerud | |
| D277,973 | S | | 3/1985 | Stenerud | |
| 4,537,397 | A | * | 8/1985 | Kopp | 473/420 |
| 4,655,453 | A | | 4/1987 | Spiegel et al. | |
| 4,657,252 | A | | 4/1987 | Spiegel | |
| D291,714 | S | | 9/1987 | Spiegel | |
| D305,448 | S | | 1/1990 | Spiegel | |
| 4,984,790 | A | * | 1/1991 | Dowdy et al. | 473/408 |
| 5,100,135 | A | * | 3/1992 | Bourgeois | 473/420 |
| 5,383,668 | A | * | 1/1995 | Andrikian | 473/132 |
| 5,407,194 | A | * | 4/1995 | Snow | 473/131 |
| 5,409,212 | A | * | 4/1995 | Arnett | 473/404 |
| D372,062 | S | | 7/1996 | Spiegel | |
| 5,613,678 | A | * | 3/1997 | McKee et al. | 473/397 |
| D382,929 | S | * | 8/1997 | DeBlieux et al. | D21/717 |
| D383,816 | S | | 9/1997 | Spiegel | |
| D383,817 | S | | 9/1997 | Spiegel | |
| 5,662,241 | A | * | 9/1997 | Sorensen | 220/630 |
| D392,705 | S | | 3/1998 | Spiegel | |
| 5,788,197 | A | * | 8/1998 | Tutela | 248/156 |

(Continued)

FOREIGN PATENT DOCUMENTS

GB 2233907 A * 1/1991

*Primary Examiner* — Mitra Aryanpour
(74) *Attorney, Agent, or Firm* — H. Jay Spiegel

(57) ABSTRACT

A tee includes a ball receiving recess shaped like the outer surface of the tip of a football so that the bottom portion of that tip may be supported within the recess. The recess is discontinuous consisting of two laterally opposed recess portions with a rearwardly facing opening and forward ribs. The opening permits the kicker to see the entirety of the football down to the tip. Textured surfaces are provided that extend forward to a downwardly depending shoulder. The textured surfaces are devised so that a football can be supported horizontally on the textured surfaces for squib kicks. The facing terminations of the recess portions are sized and configured to allow a football to be leaned against the tee engaging those terminations to allow the ball to be supported with its tip on a ground surface for onside kicks.

22 Claims, 6 Drawing Sheets

U.S. PATENT DOCUMENTS

| | | | | |
|---|---|---|---|---|
| 6,056,651 | A * | 5/2000 | Malinoff | 473/400 |
| 6,309,316 | B1 * | 10/2001 | Spiegel | 473/420 |
| 6,718,961 | B1 * | 4/2004 | Woods et al. | 124/7 |
| D489,779 | S | 5/2004 | Spiegel | |
| D507,315 | S | 7/2005 | Spiegel | |
| D507,814 | S | 7/2005 | Spiegel | |
| D513,775 | S | 1/2006 | Spiegel | |
| 7,052,416 | B2 * | 5/2006 | Chang | 473/396 |
| 7,125,349 | B2 * | 10/2006 | Tucker | 473/438 |
| D634,798 | S * | 3/2011 | Suisham et al. | D21/717 |
| 2001/0029212 | A1 * | 10/2001 | Dovigi | 473/387 |

* cited by examiner

FOOTBALL TEE WITH MULTIPLE BALL SUPPORTING MODES

BACKGROUND OF THE INVENTION

The present invention relates to a football tee with multiple ball supporting modes. The present application is related to U.S. patent application Ser. No. 29/347,638, filed Mar. 23, 2010, and titled "FOOTBALL TEE."

The present invention constitutes the latest evolution of a series of football tees invented by co-inventor H. Jay Spiegel (Spiegel) which are currently the most popular football tees now in use.

Spiegel developed the concept of supporting an American football for kickoffs using a recess that is at least partially shaped like the tip of the football. This recess replaced traditional tees that were prior art before that invention that all used upstanding prongs to support the ball. Upstanding prongs were an appropriate way to support a football when the technique for kicking the football consisted of locking the ankle and striking the ball with the front of the shoe which was squared off for that purpose. The art of soccer-style kicking was developed by Pete Gogolak of Cornell University in the early 1960s. In that technique, the kicker would strike the ball with the toe down and using the instep of the foot. With the toe down, invariably, the end of the foot would strike the prongs on the tee immediately prior to the foot striking the ball. The result was slight dislodgement of the ball from the tee just prior to impact, materially affecting the accuracy of the impact on the ball and materially affecting the trajectory and distance of travel of the ball as a result.

U.S. Pat. Nos. 4,655,453 and 4,657,252 first disclosed the concept of a ball receiving recess shaped like the tip of a football with a second recess forward of the ball receiving recess to allow the tip of the ball to spin out of the ball receiving recess when the ball was kicked. The first version of Spiegel's tees to be approved by the National Football League (in 1988) had a base as shown in U.S. Pat. No. D 305,448, and a ball receiving tee received within that recess as shown in U.S. Pat. No. D 291,714. Spiegel's tees evolved with a changed appearance of the base from its appearance in U.S. Pat. No. D 305,448 to its appearance in U.S. Pat. No. D 372,062. With the base disclosed in that patent, the rubber ball receiving tee had a changed appearance as shown in U.S. Pat. Nos. D 383,816; D 383,817; and D 392,705.

The tee consisting of the base shown in U.S. Pat. No. D 305,448 and the rubber tee of U.S. Pat. No. D 291,714 was first marketed as the TOE-TAL® tee. When the tee shown in U.S. Pat. Nos. D 372,062; D 383,816; D 383,817; and D 392,705 was commercialized, the earlier TOE-TAL® tee became obsolete and the TOE-TAL® trademark was used in association with the new iteration. That iteration continues to be on sale to this day and is highly successful.

By 1999, the TOE-TAL® tee was being used by every NFL® kicker in every NFL® game. When the NFL® informed Spiegel of its intention to outlaw the two-piece TOE-TAL® tee for NFL® use in the next year (since kickers were pushing the rubber insert up within the base to increase the elevation of the ball), the one-piece GROUND ZERO®-1 tee was developed. That tee has the appearance as shown in FIGS. 1, 2 and 4-6 of U.S. Pat. No. D 383,816. Either the TOE-TAL® tee or the GROUND ZERO®-1 tee has been used in every NFL® game since 1999. The GROUND ZERO®-2 tee is a two inch version of the one inch GROUND ZERO®-1 tee. The GROUND ZERO®-2 tee and the TOE-TAL® tee are the most popular tees currently used in high school football.

In the game of football, when a team is behind on the scoreboard in the final minutes of the game after scoring points, the team might attempt to gain another possession by performing what is called an onside kick. Under the NFL® rules, when a kickoff is done, once the ball travels 10 yards down the field, it is a live ball and either team may recover it. Thus, the onside kick is performed with the intent of having the ball travel just over 10 yards and in a fashion giving the kicking team the best chance of recovering it.

Prior to 1999, when kickers would attempt onside kicks, they would use tees traditionally designed for long kickoffs and place the ball on those tees in weird orientations. The problem with those techniques was that it was impossible for the kicker to place the ball on the tee in precisely the same orientation and configuration every time. This introduced uncertainty as to where the ball would travel when it was kicked. Spiegel solved this problem in 1999 with the development of the GROUND ZERO ONSIDE® tee. In that tee, the traditional ball receiving recess as disclosed and claimed in Spiegel's earlier patents was included. Additionally, a recess was provided in the forward wall of the tee permitting the ball to be supported leaning against the forward wall of the tee with the tip of the ball on the ground. This is the best configuration to use to successfully accomplish an onside kick. The ball could be so supported the identical way each time, thereby providing reproducibility of results each time.

Spiegel obtained U.S. Pat. Nos. 6,309,316; D 489,779; D 507,315; D 507,814; and D 513,775 covering the GROUND ZERO ONSIDE® tee. The drawing figures of U.S. Pat. Nos. D 507,315 and D 513,775 most closely resemble the current commercial version of the GROUND ZERO ONSIDE® tee. The manner of support of a football on the GROUND ZERO ONSIDE® tee is shown in FIGS. 7 and 8 of U.S. Pat. No. D 507,315 and FIG. 5 of U.S. Pat. No. D 513,775.

While the GROUND ZERO®-1, GROUND ZERO®-2, GROUND ZERO ONSIDE® and TOE-TAL® tees are the most popular tees used in the game of football today, there is always room for improvement. Anything that can enhance the versatility of a tee would be an improvement. One aspect always important to a kicker is the aspect of visibility of the ball when kicking. In the tees commercialized by Spiegel as described above, the bottom ⅝ inch of the tip of the football is contained within the recess and from the position of the kicker is not visible due to its enclosure by the ball receiving recess. Additionally, providing a tee with features facilitating supporting the ball for traditional kickoffs as well as onside kicks and squib kicks would render a tee extremely versatile. It is with these thoughts in mind that the present invention was developed.

SUMMARY OF THE INVENTION

The present invention relates to a football tee with multiple ball supporting modes. The present invention includes the following interrelated objects, aspects and features:

(1) In a first aspect, the present invention contemplates a ball receiving recess that is shaped like the outer surface of the tip of the football so that the bottom portion of that tip may be supported within the recess. However, as compared to the recess found in the Spiegel tees which is continuous around the rear of the tee, in the present invention, the recess is discontinuous consisting of two laterally opposed recess portions with a rearwardly facing opening therebetween. The rearwardly facing opening permits the kicker from his starting position to see the entirety of the football down to the bottom of the tip. This increased visibility enhances the kicker's view of the ball prior to kicking it.

(2) As in the Spiegel tees, the forward portion of the recess is open and the opening is defined by two opposed angular ribs that flex when a football is placed therein. However, in the Spiegel tees, forward of the ball receiving recess is a second recess enclosed on all sides. In the present invention, forward of the ribs, the tee is forwardly open leaving an unobstructed area allowing the ball to easily leave the tee in an unobstructed fashion.

(3) Forward of and to either side of the ribs, raised textured surfaces are provided that extend forward to a downwardly depending shoulder. The length of these textured surfaces is devised so that a football can be supported horizontally on the textured surfaces with the laces engaging the shoulder, thus supporting the football for squib kicks. Between the textured surfaces, a lower elongated area or floor is provided which is at the same elevation of the bottom of the ball receiving recess and extends forward to a lower triangular area which combines with the earlier-mentioned areas to provide a directional arrow allowing the kicker to line up the tee for accurate kicking.

(4) At the rear of the tee, its body slopes down from the bottom of the recess portions to the ground surface. The facing terminations of the recess portions have surfaces sized and configured to allow a football to be leaned against the tee engaging those surfaces to allow the ball to be supported with its tip on a ground surface for onside kicks. If desired, the surfaces may be slanted to best engage the surfaces of the football to support it for onside kicks.

(5) The undersurface of the tee is dished so that the tee is supported on the ground surface only at the periphery of the tee and the grass on the ground surface where the tee is supported may enter the dished portion to allow the tee to be supported on the ground surface in a level configuration.

Accordingly, it is a first object of the present invention to provide a football tee with multiple ball supporting modes.

It is a further object of the present invention to provide such a tee in which a ball may be supported for traditional kickoffs, onside kicks, and squib kicks.

It is a further object of the present invention to provide such a tee in which the ball receiving recess is rearwardly discontinuous allowing the kicker to see the entirety of the tip of the football prior to kicking it.

It is a yet further object of the present invention to provide such a tee in which facing terminations of recess portions include surfaces facilitating supporting the football for onside kicks.

It is a still further object of the present invention to provide such a tee in which a surface extends between the recess portions and a squib kick supporting portion and includes a triangular portion combining to create a directional arrow.

It is a still further object of the present invention to provide such a tee in which the undersurface is dished to allow the tee to be supported in a level fashion on a ground surface.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
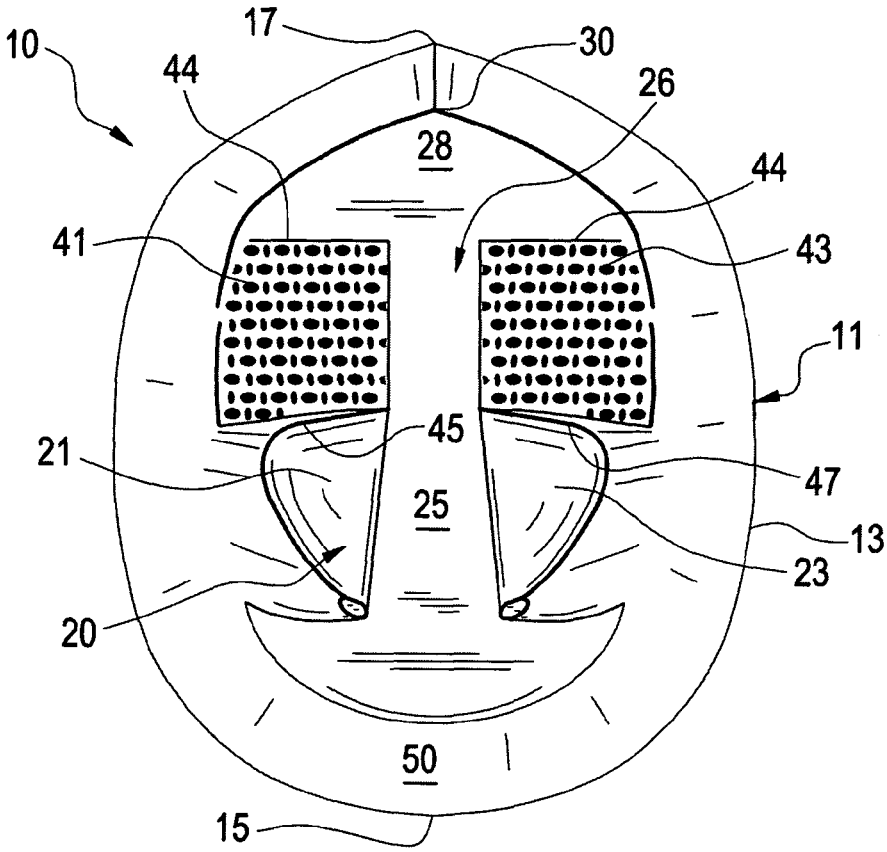
FIG. 1 shows a top view of the present invention.

With reference to the figures, the present invention is generally designated by the reference numeral 10 and consists of a base 11 having a bottom periphery 13 including an arcuate rear portion 15 and a pointed forward portion 17.

A ball receiving recess is generally designated by the reference numeral 20 and is made up of recess portions 21 and 23 separated by an open area 25. The recess portions are defined by two opposed upstanding portions 27 and 29 (FIG. 5) that have facing terminations 31 and 33, respectively. The facing termination 31 includes a slanted surface 35, and the facing termination 33 has a slanted surface 37. The surfaces 35 and 37 are provided for a purpose to be described in greater detail hereinafter.

Figure 2:
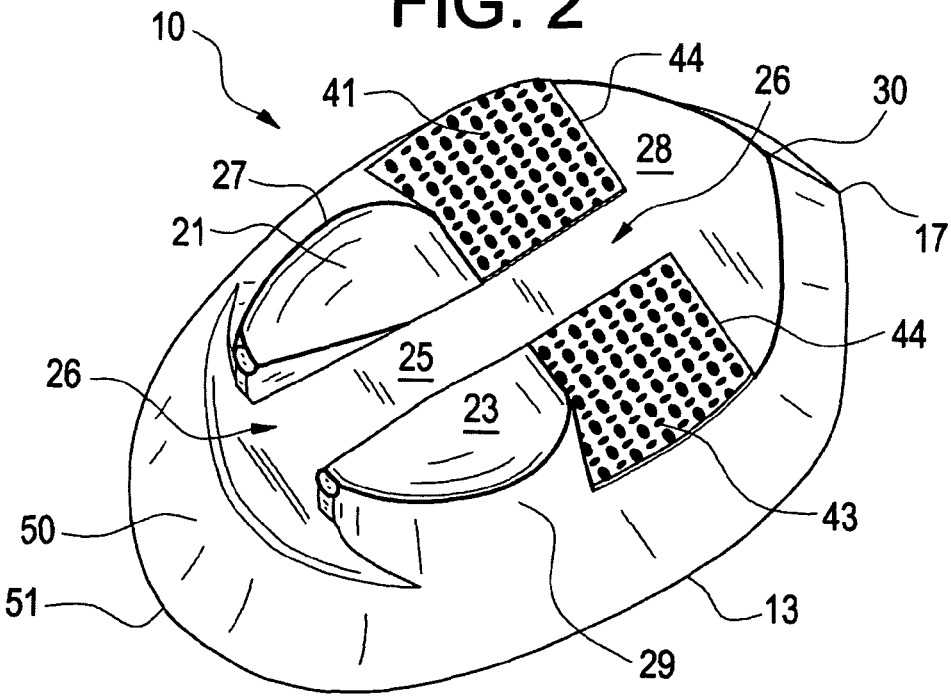
FIG. 2 shows a right, rear perspective view thereof.
Figure 4:
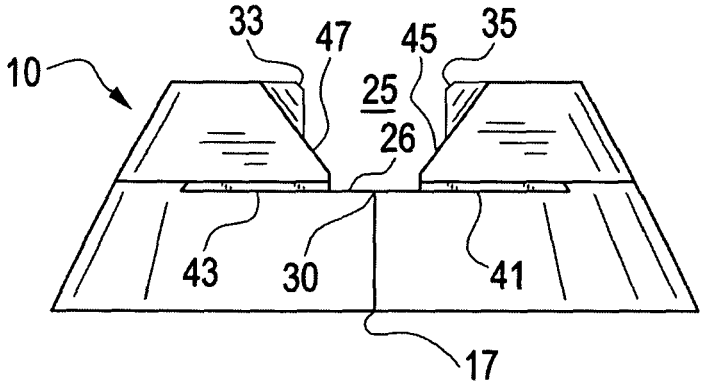
FIG. 4 shows a rear view thereof.
Figure 5:
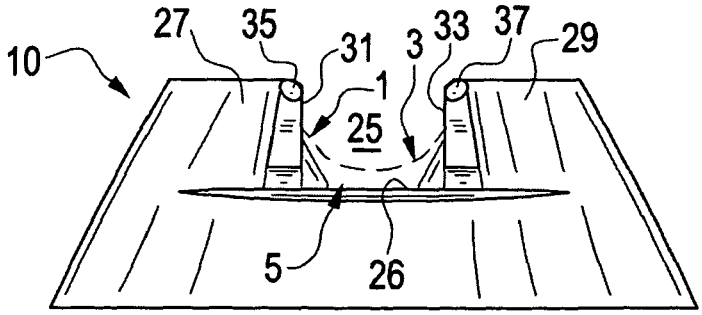
FIG. 5 shows a front view thereof.

The open area 25 between the recess portions 21 and 23 is defined by a substantially flat floor 26 (FIGS. 4 and 5). The floor 26 extends forward of the recess portions 21 and 23 and merges with a triangular forward flat portion 28 (FIGS. 1 and 2). The floor 26 and the triangular portion 28 combine together to create the appearance of a directional arrow including a forward point 30 above the pointed forward portion 17 of the periphery 13 of the tee 10.

To either side of the floor 26 and rearward of the triangular portion 28, two textured raised surfaces 41 and 43 are provided. The raised nature of the surfaces 41 and 43 is seen in FIG. 4.

The forward termination of the ball receiving recesses 21 and 23 is defined by angled inwardly extending ribs 45 and 47 (FIGS. 1 and 4). The ribs 45 and 47 are thin and flexible. When a football is placed into the recess 20, the ribs 45 and 47 flex outwardly toward the triangular portion 28 and the restoring force of the material from which the tee 10 is made biases the ribs rearward to help hold the football in place within the recess 20 until it is kicked.

Figure 3:
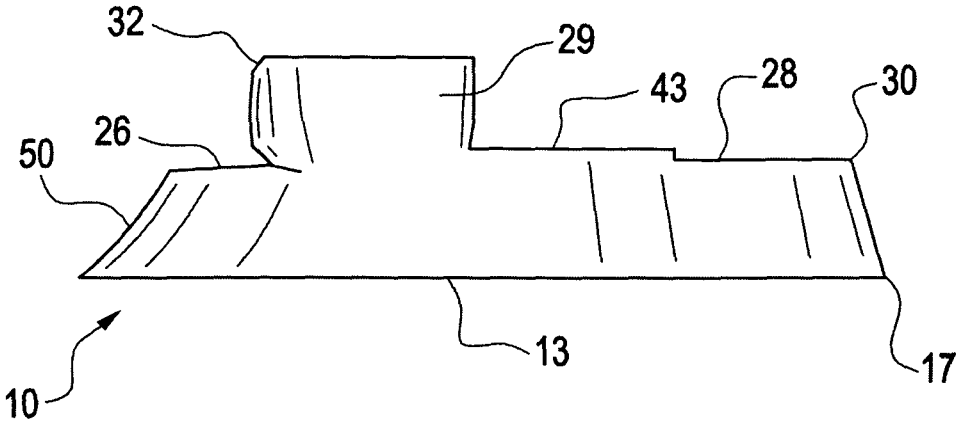
FIG. 3 shows a right side view thereof of which the other side view is identical.
Figure 6:
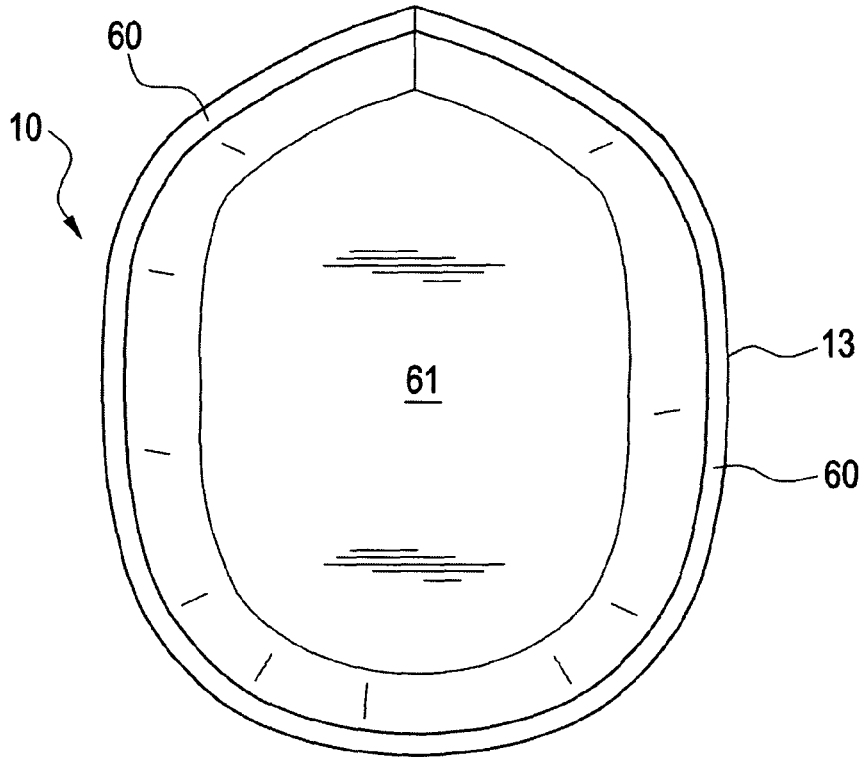
FIG. 6 shows a bottom view thereof.

FIGS. 2 and 3 best show the sloping rear surface 50 of the tee 10 below the surface 26. With reference to FIG. 6, it is seen that the underside of the tee reveals a thin peripheral edge 60 extending completely around its circumference. The portion 61 is recessed to provide a volume on the underside of the tee that allows grass to enter it when the tee is placed on the ground to allow the tee to be placed level on the ground surface.

Figure 7:
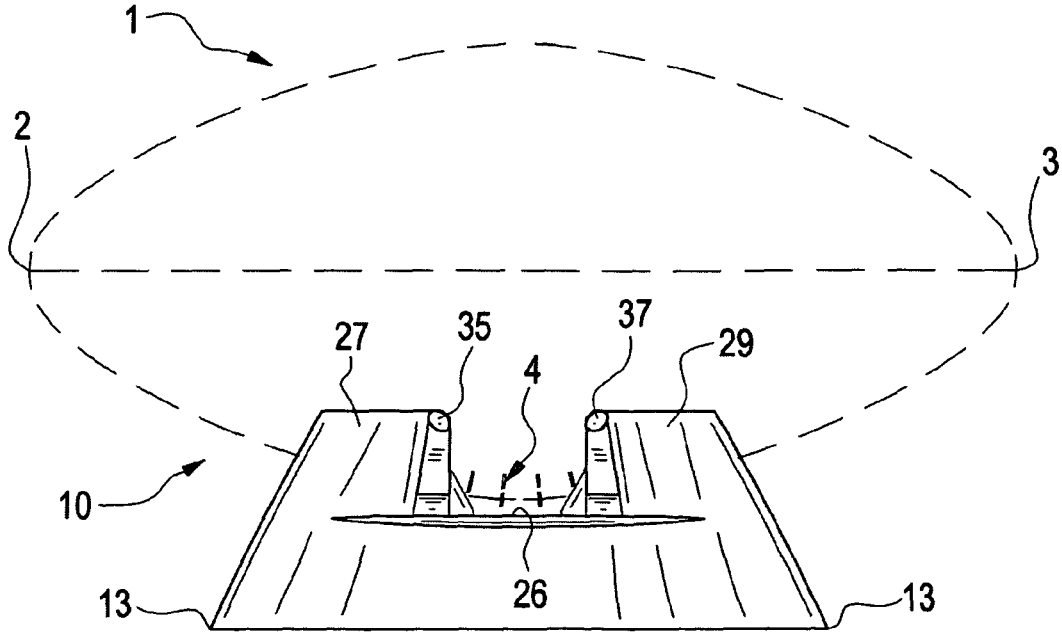
FIG. 7 shows a view similar to that of FIG. 5 and showing in broken lines a first possible orientation of a football on the claimed tee.

With reference to FIGS. 7-10, a typical football 1 includes tips 2 and 3 as well as laces 4. With reference to FIG. 7, a football 1 is seen supported on the surfaces 41 and 43. A shoulder 44 is defined between the forward edges of the surfaces 41, 43 and the surface 28. This is best seen with reference, for example, to FIGS. 8 and 9. The laces 4 of the football 1 engage the shoulder 44 with the ball itself sitting on the surfaces 41 and 43. The slight elevation of the surfaces 41 and 43 above the surfaces 26 and 28 is provided for a specific purpose. In particular, when a football is received on the tee 10 with one of its tips 2, 3 received within the ball receiving recess 20, in fact, the tip 2 or 3 is slightly suspended above the surface of the floor 26 by a distance "S" (See FIG. 5). The tee is designed in this fashion to reduce the frictional interaction between the ball 1 and the tee 10. In that configuration, as the tee is designed in its preferred embodiment, the tip 2 or 3 is suspended exactly one inch above the periphery 13 of the tee as it sits on a ground surface. The spacing of the tip 2 or 3 of the football from the floor 26 is equal to the elevation of the surfaces 41, 43 above the floor 26. As such, when a football 1 is supported sideways on the surfaces 41, 43 as seen in FIG. 7, the bottom of the football at the location adjacent the laces is exactly one inch above the periphery 13 of the tee and thus of the ground surface.

Figure 8:
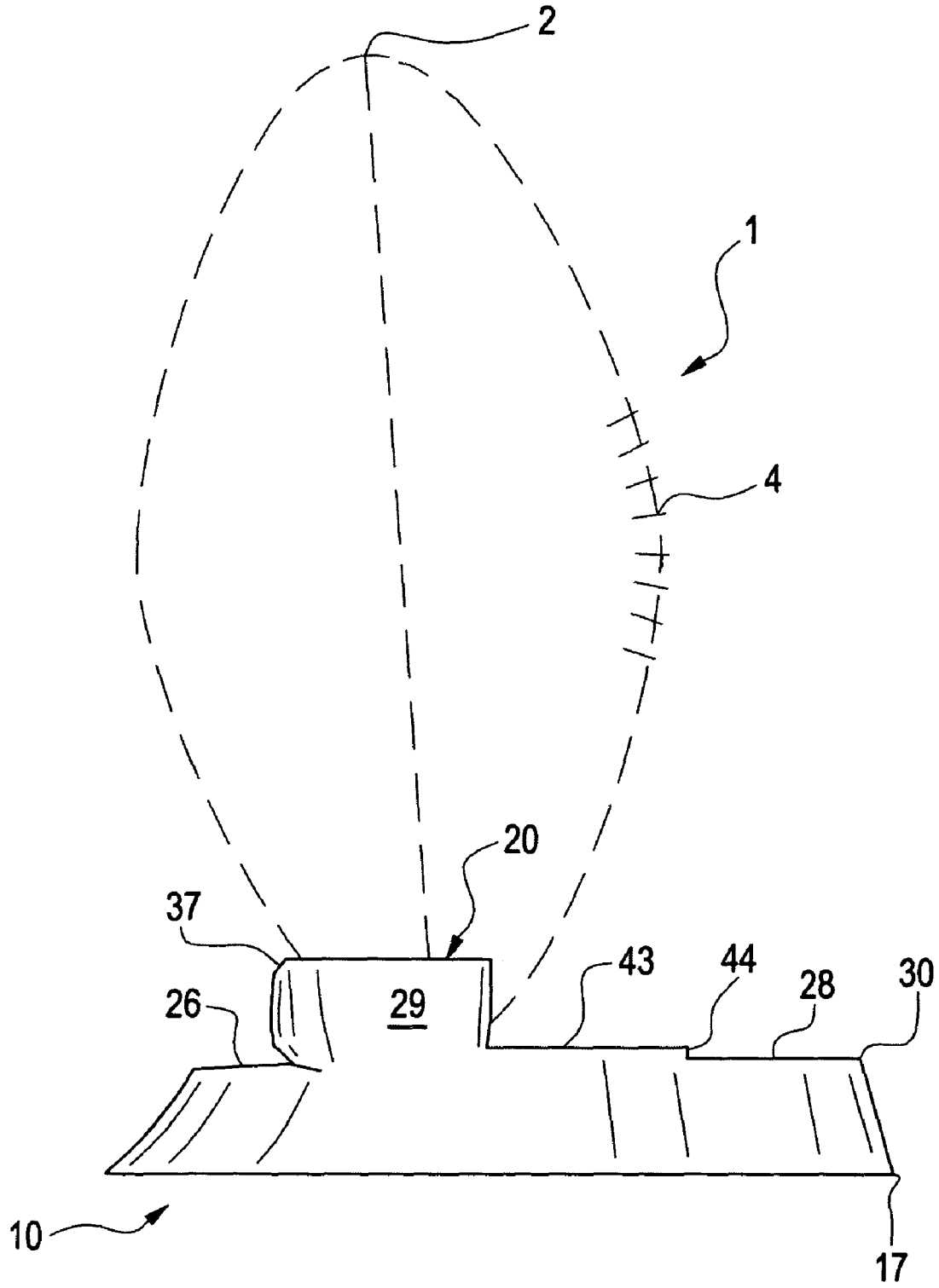
FIG. 8 shows a view similar to that of FIG. 3 and showing in broken lines a second possible orientation of a football on the claimed tee.

With reference to FIG. 8, the ball 1 is seen received within the ball receiving recess 20. In that configuration, a conventional kickoff can be carried out. As should be understood from FIGS. 1, 2, 4 and 5 in particular, in that configuration, the kicker can view the entire tip of the football slightly suspended above the floor 26 as the kicker approaches the ball to kick it off the tee 10.

Figure 9:
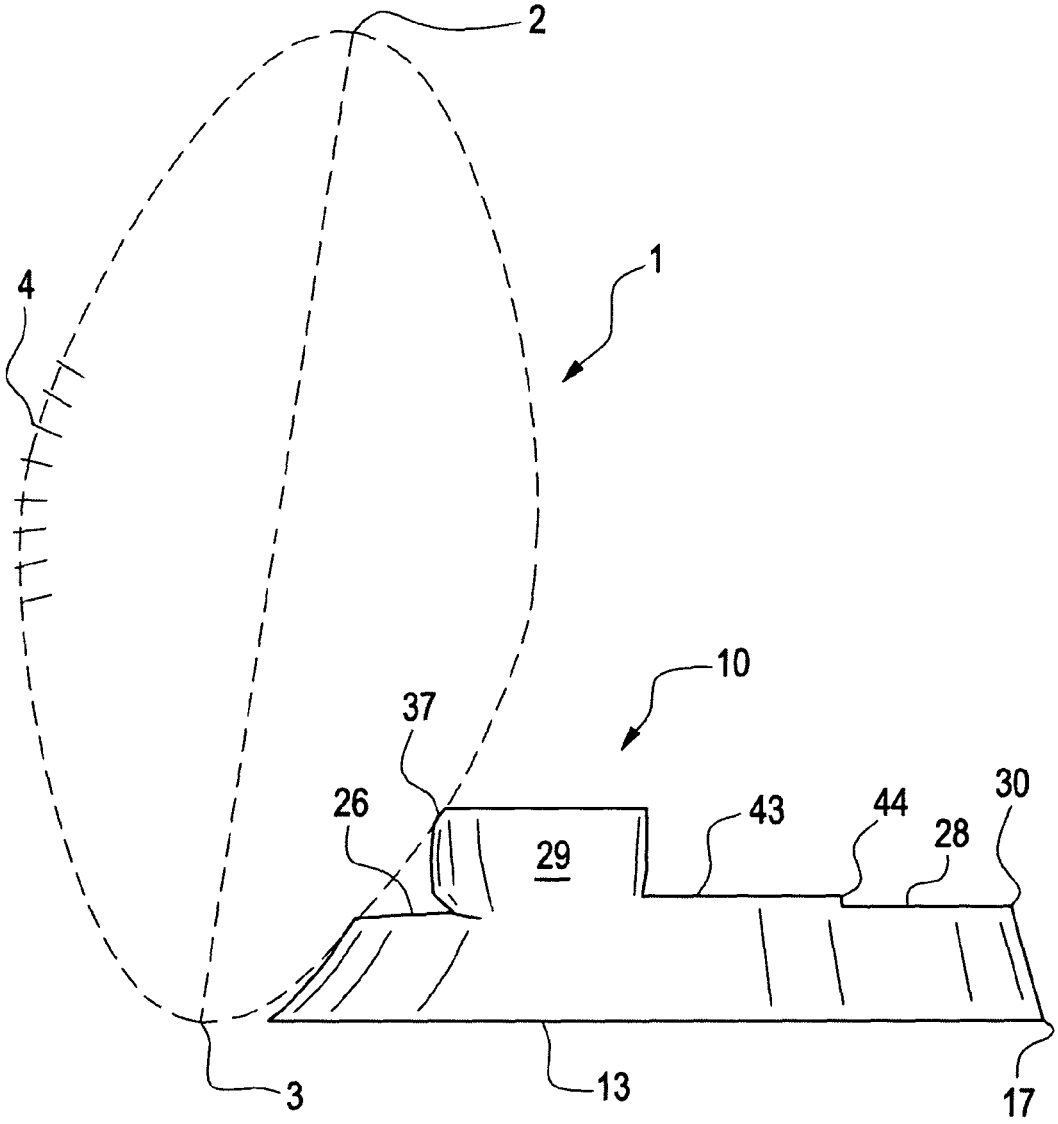
FIG. 9 shows a view similar to that of FIG. 8 and showing in broken lines a third possible orientation of a football on the claimed tee.

With reference to FIG. 9, when it is desired to make an onside kick, the football is supported with its tip 3 on the ground surface (not shown) and the side surfaces of the ball engage the surfaces 35 and 37 (the surface 37 shown in FIG. 9) to support the ball in the configuration shown in FIG. 9. The laces 4 face rearwardly away from the tee 10 as seen in FIG. 9.

Figure 10:
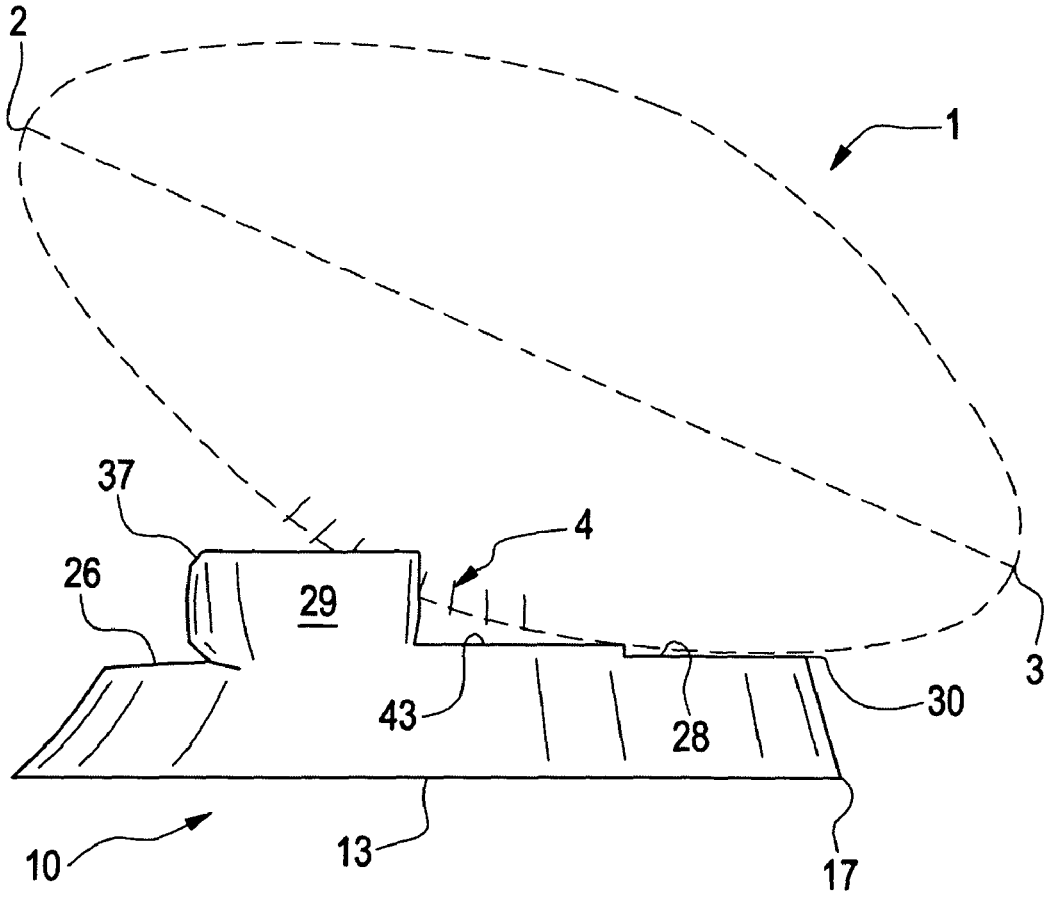
FIG. 10 shows a view similar to that of FIGS. 8 and 9 and showing in broken lines a fourth possible orientation of a football on the claimed tee.

FIG. 10 shows a further way of supporting the football 1 with the laces 4 facing downwardly and the football supported on the shoulder 43, the point 30, and the ribs 45, 47. In that orientation, an additional type of squib kick can be carried out.

In the preferred embodiment of the present invention, the tee 10 is made of rubber or soft plastic. The durometer of the tee is chosen to enhance the flexibility of the ribs 45, 47. Materials such as reclaimed rubber, synthetic rubber, natural rubber, soft plastics such as those known by the name "ROOM TEMPERATURE VULCANIZE" can also be employed. The technique for manufacturing the tee can include pressure molding, injection molding, as well as vacuum forming.

As such, an invention has been disclosed in terms of a preferred embodiment thereof, which fulfills each and every one of the objects of the present invention and provides a new and useful football tee with multiple ball supporting modes of great novelty and utility.

Of course, various changes, modifications, and alterations in the teachings of the present invention may be contemplated by those of ordinary skill in the art without departing from the intended spirit and scope thereof.

As such, it is intended that the present invention only be limited by the terms of the appended claims.

The invention claimed is:

1. A kicking tee, comprising:

a) a base having a periphery including a rear surface;

b) said base having a ball receiving recess extending upwardly and comprising two recess portions separated at rearward terminations thereof by a space and defined at forward terminations thereof by a pair of ribs defining a further space therebetween;

c) each of said recess portions having a surface with a shape approximating a shape of a portion of an outer surface of an oblate spheroidal football adjacent a tip of said football;

d) whereby, when a tip of a football and adjacent portions of said outer surface of said football are placed in said ball receiving recess with said adjacent portions in engagement with said surfaces of said recess portions, said tip and said adjacent portions are visible through said space between said recess portions.

2. The kicking tee of claim 1, wherein between said space and further space, a floor extends, between said recess portions.

3. The kicking tee of claim 2, wherein said floor extends forward of said further space to a forward edge of said tee.

4. The kicking tee of claim 3, wherein two raised surfaces are located forward of said ribs and to either side of said floor.

5. The kicking tee of claim 4, wherein said raised surfaces are textured.

6. The kicking tee of claim 3, wherein a forward termination of said floor is forwardly pointed.

7. The kicking tee of claim 6, wherein an entirety of said floor has a shape of an arrow.

8. The kicking tee of claim 1, wherein said rearward terminations of said recess portions have ball supporting surfaces separate from and rearward of said ball receiving recess.

9. The kicking tee of claim 8, wherein said ball supporting surfaces of said rearward terminations engage surfaces of a football located rearward of said tee.

10. The kicking tee of claim 5, wherein said raised surfaces support a football forward of said ribs.

11. The kicking tee of claim 1, including a dished undersurface with a narrow periphery supporting said tee on a ground surface.

12. The kicking tee of claim 10, wherein a shoulder is formed between a forward edge of said raised surfaces and said floor.

13. The kicking tee of claim 12, wherein said shoulder engages laces of a football placed on said raised surfaces.

14. The kicking tee of claim 1, made of rubber.

15. The kicking tee of claim 1, made of plastic.

16. A kicking tee, comprising:

a) a base having a periphery including a rear surface;

b) said base having a ball receiving recess extending upwardly and comprising two recess portions separated at rearward terminations thereof by a space and defined at forward terminations thereof by a pair of ribs defining a further space therebetween;

c) each of said recess portions having a surface with a shape approximating a shape of a portion of an outer surface of an oblate spheroidal football adjacent a tip of said football;

d) whereby, between said space and further space, a floor extends between said recess portions and forward of said further space to a forward edge of said tee;

e) whereby, when a tip of a football and adjacent portions of said outer surface of said football are placed in said ball receiving recess with said adjacent portions in engagement with said surfaces of said recess portions, said tip and said adjacent portions are visible through said space between said recess portions.

17. The kicking tee of claim 16, wherein two raised textured surfaces are located forward of said ribs and to either side of said floor.

18. The kicking tee of claim 16, wherein a forward termination of said floor is pointed, whereby said floor has a shape of an arrow.

19. The kicking tee of claim 16, wherein said rearward terminations of said recess portions have ball supporting surfaces separate from and rearward of said ball receiving recess which engage surfaces of a football located rearward of said tee.

20. The kicking tee of claim 17, wherein said raised surfaces support a football forward of said ribs, a shoulder being formed between a forward edge of said raised surfaces and said floor, said shoulder engaging laces of a football placed on said raised surfaces.

21. A kicking tee, comprising:

a) a base having a periphery including a rear surface;

b) said base having a ball receiving and engaging recess extending upwardly and comprising two recess portions separated at rearward terminations thereof by a space and defined at forward terminations thereof by a pair of ribs defining a further space therebetween;

c) each of said recess portions having a surface with a shape of a portion of an outer surface of an oblate spheroidal football adjacent a tip of said football;

d) whereby, when a tip of a football is placed in said ball receiving recess with said portion of said outer surface of said football in engagement with said surfaces of said recess portion, said tip is visible through said space between said recess portions.

22. A kicking tee, comprising:

a) a base having a periphery including a rear surface;

b) said base having a ball receiving and engaging recess extending upwardly and comprising two recess portions separated at rearward terminations thereof by a space and defined at forward terminations thereof by a pair of ribs defining a further space therebetween;

c) each of said recess portions having a surface with a shape of a portion of an outer surface of an oblate spheroidal football adjacent a tip of said football;

d) whereby, between said space and further space, a floor extends between said recess portions and forward of said further space to a forward edge of said tee;

e) whereby, when a tip of a football is placed in said ball receiving recess with said portion of said outer surface of said football in engagement with said surfaces of said recess portion, said tip is visible through said space between said recess portions.

* * * * *